US006147611A

United States Patent [19]

Otero

[11] Patent Number: 6,147,611

[45] Date of Patent: Nov. 14, 2000

[54] PERSONAL AND PORTABLE ALARM APPARATUS

[76] Inventor: Armando Otero, 714 W. Virginia Ave., Tampa, Fla. 33603

[21] Appl. No.: 09/458,968

[22] Filed: Dec. 10, 1999

[51] Int. Cl.[7] ..... G08B 13/00

[52] U.S. Cl. ..... 340/574; 340/573; 340/573.1; 340/573.4; 340/691; 340/693

[58] Field of Search ..... 340/573, 573.1, 340/574, 693, 691, 573.4

[56] References Cited

U.S. PATENT DOCUMENTS

| | | | |
|---|---|---|---|
| 4,158,197 | 6/1979 | Takagaki | 340/574 |
| 4,665,389 | 5/1987 | Clendening | 340/574 |
| 5,196,829 | 3/1993 | Janis | 340/574 |
| 5,512,881 | 4/1996 | Majmuda | 340/574 |
| 5,629,679 | 5/1997 | Cranford et al. | 340/574 |
| 5,797,091 | 8/1998 | Clise et al. | 455/404 |
| 5,986,540 | 11/1999 | Nakagaki et al. | 340/384.7 |
| 6,028,514 | 10/1998 | Lemelson et al. | 340/539 |

*Primary Examiner*—Daniel J. Wu
*Assistant Examiner*—Hung Nguyen

[57] ABSTRACT

A personal alarm apparatus for preventing or stopping attackers from attacking women. The alarm apparatus having a attachment system for affixing to the front middle strap of a bra and having a shock sensing mechanism that is triggered when the women is attacked. The apparatus is also activated by voice recognition and manual override. Additionally, when the alarm is activated, a transmitter sends a signal to the victim's car alarm system to activate the car alarm for additional attention. The personal device is to be worn and attached onto the bra of the female and concealed under the garment she is wearing.

1 Claim, 5 Drawing Sheets

PERSONAL AND PORTABLE ALARM APPARATUS

BACKGROUND

1. Field of the Invention

Generally, this invention is directed towards an alarm system for deterring criminals and attackers. More specifically, this invention relates to a personal and portable alarm system that affixes to a woman's bra, emits an audio signal, and is activated via shock sensor, voice recognition and manual override.

2. Description of the Prior Art

Today, with the increase of attacks on individuals, particularly women, alarms systems have become the norm for personal protection. In U.S. Pat. No. 4,333,203, "A cylindrical personal protection device is disclosed having an aerosol cylinder with a nozzle, a light and a removable safety cap. In an embodiment with dual cylinders, the cylinders contain a deterrent spray and a glowing liquid. A trigger proximate the cylinders expels the contents of the cylinders where they are mixed prior to expulsion. A body section has a battery receiving area and an alarm. The electronics connect the battery receiving area, trigger, alarm and light. The electronics activates the light and alarm, in response to activation of the trigger, causing them to pulse simultaneously. The cylinders and the body portion are removably connected to one another. A safety lid prevents activation of the trigger."

In U.S. Pat. No. 4,554,698, "A key chain alarm and light is disclosed that overcomes the problems associated with prior art personal alarms. The invention combines the functionality of a key chain, flashlight and an alarm into a unitary assembly. The invention is physically diminutive in size and ergonomically shaped to facilitate its handling. However, it produces an audible alarm significantly louder than other prior art devices. The invention utilizes a unique speaker assembly to produce an extremely loud alarm signal. A piezoelectric transducer provides the vibratory medium. The vibrations produced by the transducer are acoustically focused and harmoniously amplified by an acoustic chamber before passing into a reverberation chamber. The reverberation chamber also increases the amplitude of the sound waves before selectively releasing them to produce the alarm signal. This signal immediately draws attention to the user in emergency situations. The alarm is easily activated by simply moving a switch to activate the alarm. The alarm can also be easily deactivated by reversing the switch. The switch also cooperatively activates the light. A push button on the exterior of the casing of the key chain alarm and light must also be depressed to activate the light."

In U.S. Pat. No. 5,517,180, "A cylindrical personal protection device is disclosed having an ampule section containing a flexible, multi-chamber ampule with a nozzle, a light and a removable safety cap. The ampule contains a deterrent spray and a glowing liquid. At least a portion of the ampule portion is removable allowing access to the ampule. A trigger proximate the ampule extends beyond the periphery of the ampule section. A body section has a battery receiving area and an alarm. The electronics connect the battery receiving area, trigger, alarm and light. The electronics activates the light and alarm, in response to activation of the trigger, causing them to pulse simultaneously. The ampule portion and the body portion are removably connected to one another. At least a pair of protective bumpers prevent damage. A safety pin prevents the trigger from contacting the ampule and partial removal of the safety pin allows the trigger to contact the ampule, expelling the contents of the ampule, and activating the alarm and light."

In U.S. Pat. No. 5,512,881, an "Alarm apparatus which generates a repetitive sound wave having at least two pulses of predetermined frequencies within a predetermined interval of time. A resonator generates the clock frequency therefor. The resonator may have a low tolerance of less than about 0.1 percent so that at least two pulses may be detected by a receiver having a similarly low tolerance so that false triggering of the receiver by other transmitters or background noise may be prevented. A plug is inserted into the alarm housing to maintain circuitry for initiating operation thereof open. Pulling of the plug from the housing allows the circuitry to close to initiate operation of the alarm. A push button is provided on the end of the plug to close the circuitry for initiating operation of the alarm while the plug is inserted into the apparatus. Once the alarm has been initiated, the circuitry is such that the alarm cannot be inactivated except by removal of the internal power source."

While some of the prior art may contain some similarities relating to the present invention, none of them teach, suggest or include all of the advantages and unique features of a personal alarm system that attaches to the bra of a female and is activated by either shock or voice recognition.

SUMMARY

The present invention is directed towards a personal alarm system that would prevent or stop an attacker from assaulting a victim. The system is design to be activated with either a shock sensor or voice activating from the victim. A manual activation button is also incorporated. Additionally, when the alarm is activated, a transmitter sends a signal to the victim's car alarm system to activate the car alarm for additional attention. The personal device is intended to be worn and attached onto the bra of the female and concealed under the garment she is wearing.

Accordingly, it is an object of this invention to provide a personal alarm system that can be attached to a bra of a female and concealed under the clothing being worn.

Another object of this invention to provide a personal alarm system that will emit an audio signal when activated.

Still another object of this invention to provide a personal alarm system that will be activated by a shock sensor. When and if the victim wearing the device is attacked, the device will automatically emit an audio transmission.

A further object of this invention is to provide a personal alarm system that will be activated by voice activation. When and if the victim wearing the device is attacked, the victim simply says or yells a key word such as, "Help", and the personal alarm will be activated.

Still a further object of this invention is to provide a personal alarm system that will be activated by a manual button. When and if the victim wearing the device is attacked, the victim simply presses the activation button to activate the alarm system.

Other objects and a fuller understanding of the invention will become apparent from reading the following detailed description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG. 1, sheet two contains FIG. 2, sheet three contains FIG. 3, sheet four contains FIG. 4, and sheet five contains FIG. 5.

LIST OF ELEMENTS

Figure 1:
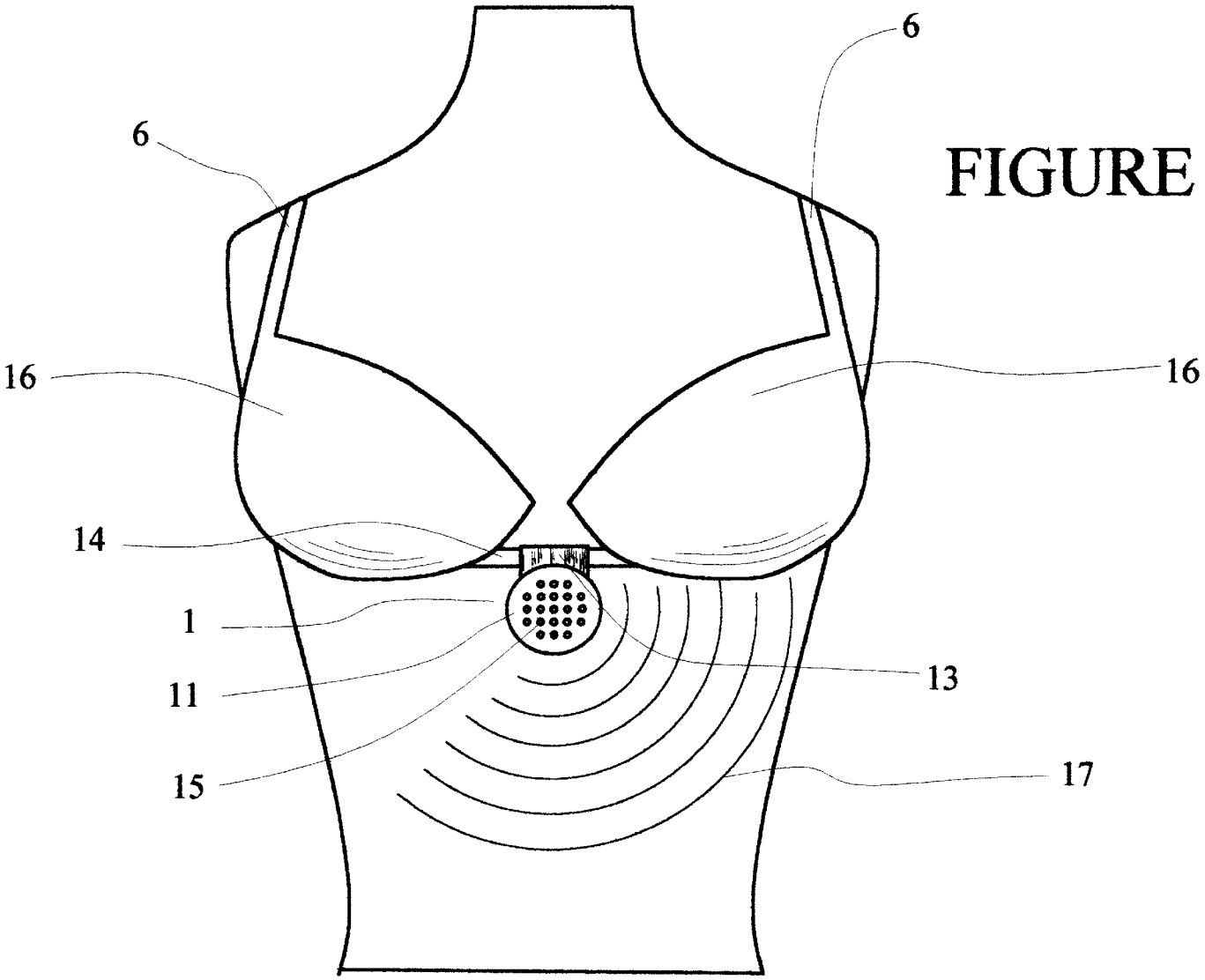
FIG. 1 is a front view of the invention showing the personal alarm apparatus affixed to the front middle portion of a bra strap.

1. Personal alarm apparatus
2. Central processor
3. Memory chip
4. Power supply
5. Transmitter
6. Upper bra strap
7. Microphone
8. Shock sensor
9. Manual activation
10. Speaker
11. Side of apparatus
12. Top supporting member
13. Affixing hook
14. Middle bra strap
15. Speaker holes
16. Bra
17. Audio signal
18. Infrared signal

DESCRIPTION OF THE PREFERRED EMBODIMENTS

Referring now to FIGS. 1–5, starting with FIG. 1, we see a personal alarm apparatus 1 affixed to the front middle strap 14 of a typical women's bra. The alarm apparatus 1 is shown in an active mode emitting an audio signal 17 to scare away would be attackers and to get the attention of surrounding people. The apparatus 1 is affixed to the strap 14 of the bra via hook 13.

Figure 2:
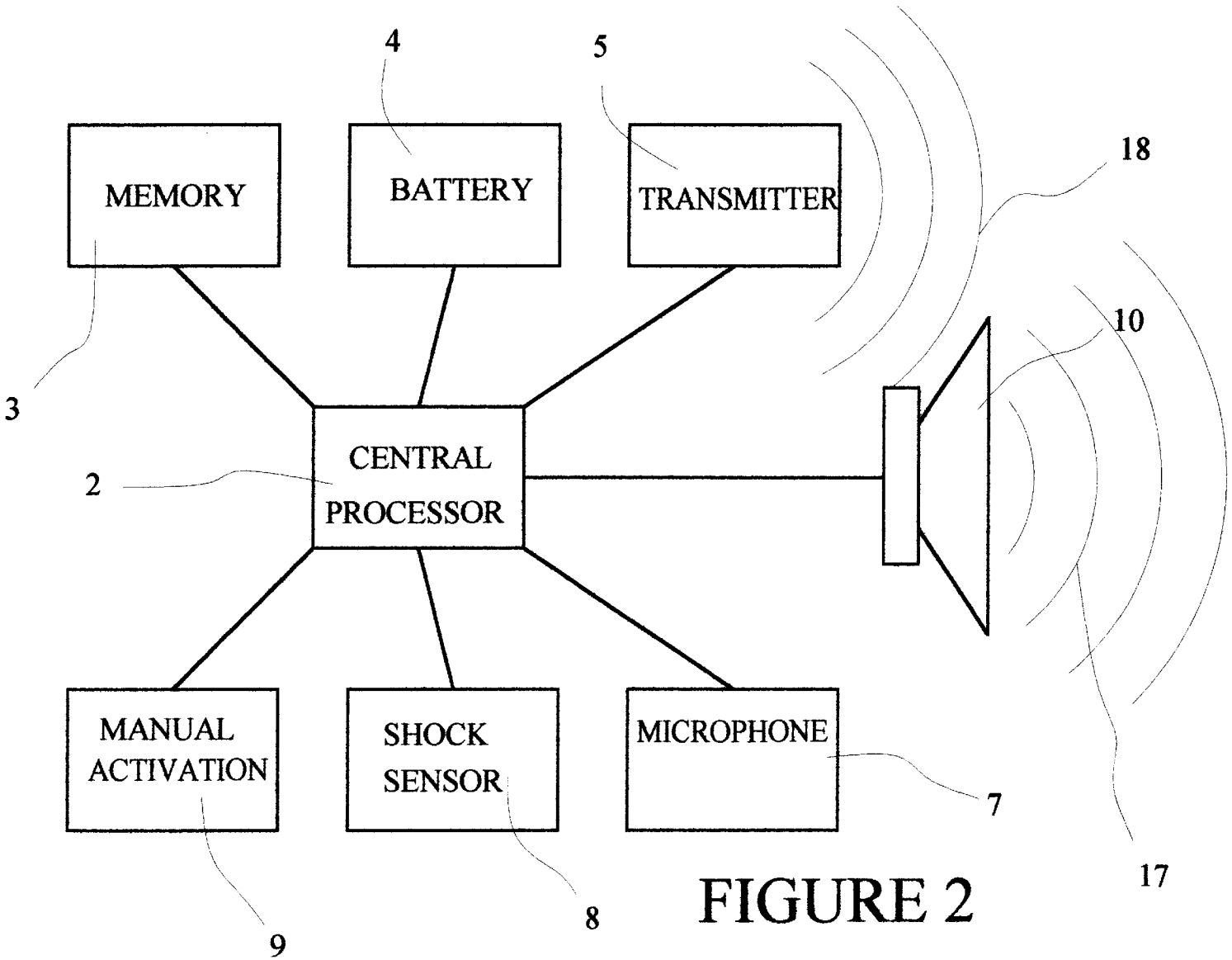
FIG. 2 shows a block diagram of the internal components of the personal alarm apparatus.

FIG. 2 shows a block flow diagram of the primary components used in the personal alarm apparatus 1. Typically, a battery or power supply 4 supplies power to a central processor 2 or circuit board whereby the central processor is used to control and activate the components of the apparatus 1. A speaker 10 is used to transmit audio signals 17 outward from the apparatus via holes 15 to scare away attackers and attract would be helpers. Depending upon the type of speaker 10 used, an ultra high frequency, ultra high decibel signal 17 is emitted from the speaker 10. Verbal audio messages can be integrated into the audio signal 17 to transmit specific messages.

The microphone 7 shown in FIG. 2 is used primarily for the voice-activated version of the apparatus 1. Initially, the apparatus is programmed to be activated by a key word such as, "Help." The user first states the key word into the microphone 7 using her own voice. Voice recognition software from the memory storage 3 scans and records the person's specific voice signature back into the memory storage 3. The microphone 7 continuously scans for the key audio signal "Help" from the user's specific voice signature. Once the key audio signal has been detected and matches with the specific voice signature from the user, the alarm apparatus 1 is activated and the speaker 10 is turned on thereby transmitting an audio signal.

Many times a user can be shocked by an attacker and attacked before any defensive action can be taken. If the user or victim in this case is struck anywhere in close proximity to the apparatus, a built-in shock sensor 8 senses this shock and activates the alarm apparatus. A shock sensor 8 is added to the personal alarm apparatus 1 to activate the alarm system when the user is attacked or hit by an attacker in close proximity to the device 1. The shock sensor 8 works in a similar manner as with the shock sensors used in automobile alarm and toys. When the apparatus 1 is jolted suddenly the shock sensor senses this movement and activates the alarm.

In addition to the shock sensor and voice activation is a manual activation button 9 that can be manually pressed to activate the personal alarm apparatus. If for some reason the automated triggers of the voice recognition and shock sensor fail to work, a manual button 9 is provided to allow the user to manual activate the alarm apparatus 1.

Many victims are attacked in parking lots in close proximity to their vehicles. In addition, many people today have automobile alarms installed in their vehicle that can be activated via an infrared signal form their key-chain remote. Another unique feature of this invention is the built-in transmitter 5 incorporated into the apparatus 1. When the personal alarm is activated via shock sensor, voice recognition, or manual, the built-in transmitter 5 sends a signal to the user's vehicle to activate the alarm system of the vehicle. The alarm system ads further attention-grabbing noise to the vicinity of the attack.

Figure 3:
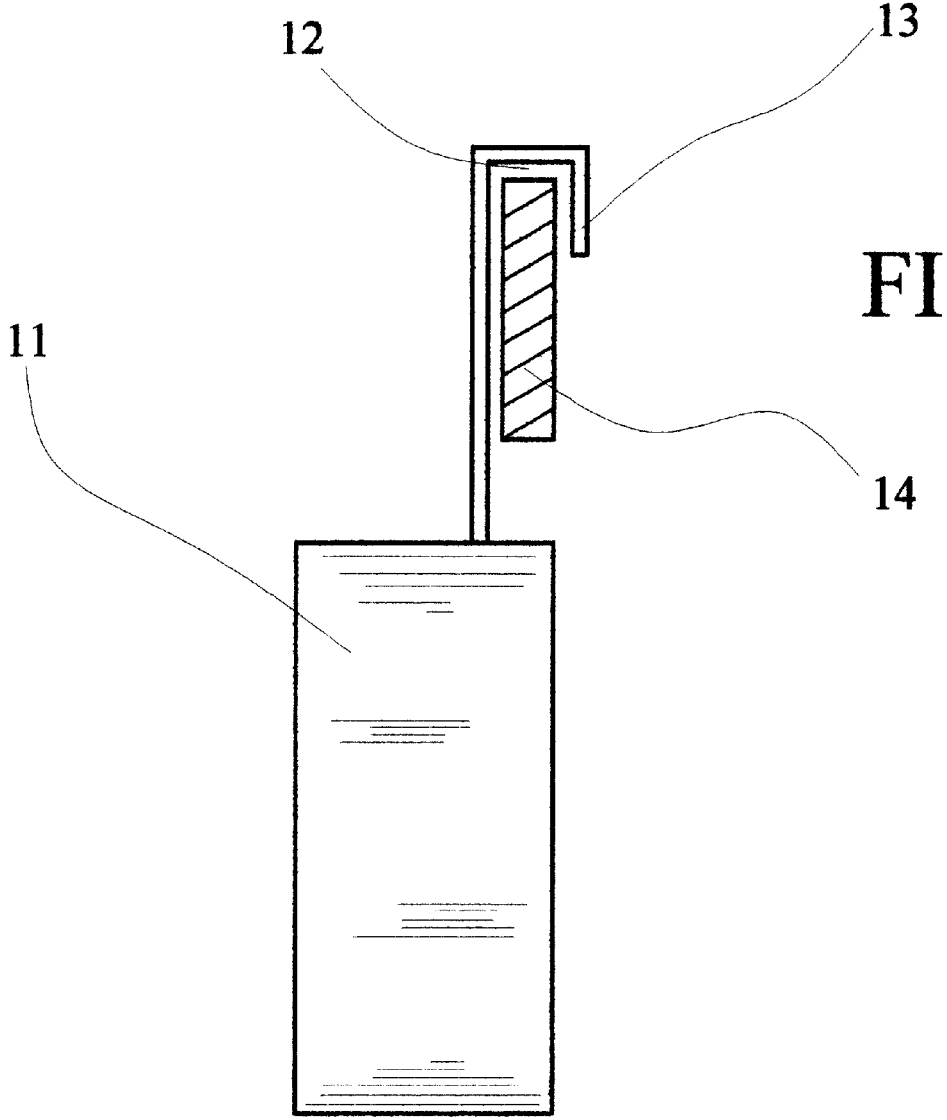
FIG. 3 shows a side, cross-sectional view of the personal alarm apparatus affixed to a bra strap.
Figure 4:
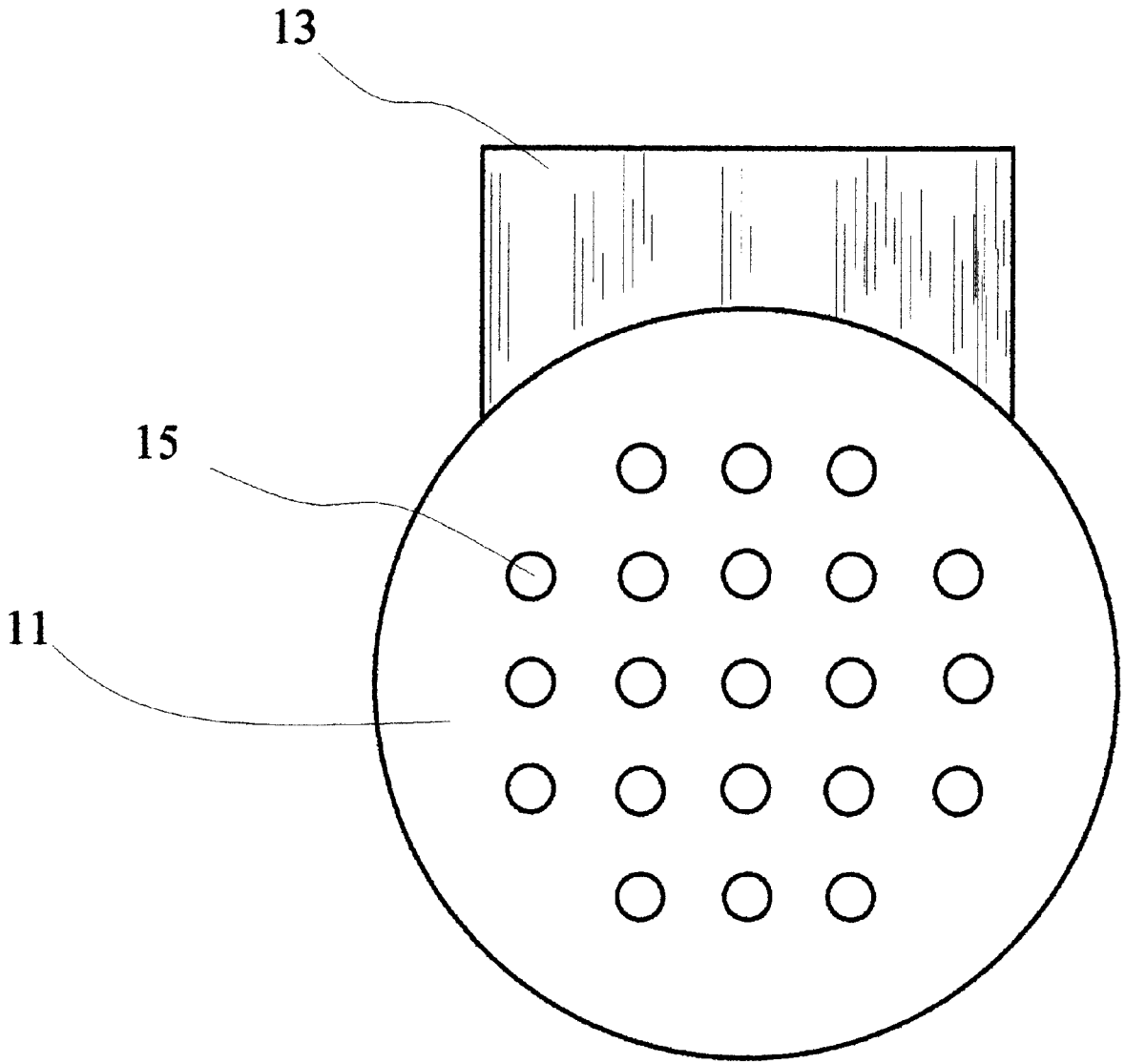
FIG. 4 shows a front view of the personal alarm apparatus.
Figure 5:
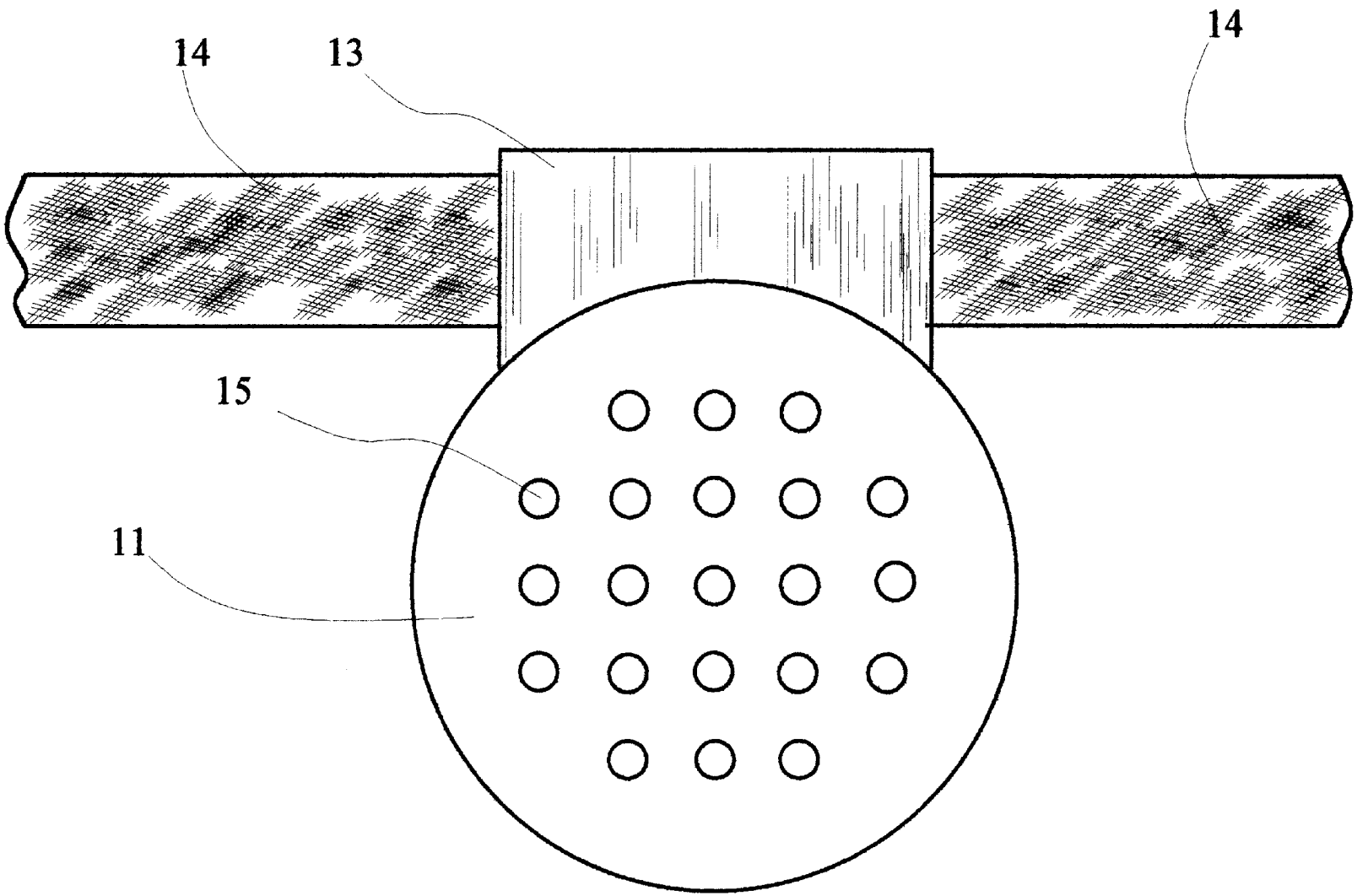
FIG. 5 shows a front view of the personal alarm apparatus affixed to a bra strap.

FIGS. 3–5 shows a simple attachment means in which a hook 13 fits over most bra strap 14 in the middle front portion. To install the apparatus 1, the user simply slides the hook or snap hook over the top portion of the strap 14. Gravity and the snug fit from the hook maintain the apparatus 1 in the proper position.

Since minor changes and modifications varied to fit particular operating requirements and environment will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A personal alarm apparatus for protecting individuals from attackers, said apparatus comprising:

a. a housing having a substantially cylindrical configuration with a front surface and a back surface, b. a means of affixing said housing on the front middle portion of a bra strap, c. a power supply powering internal components of said apparatus d. a central processor chip electrically affixed to said power supply for operating and controlling the internal components of said apparatus, e. at least one speaker electrically affixed to said central processor for transmitting audio signals from said apparatus, f. at least one shock sensor for sensing shocks and electrically connected to said central processor, g. a transmitter electrically affixed to said central processor, said transmitter transmitting signals to a secondary alarm system.

h. a microphone electrically affixed to said central processor, said microphone detecting audio transmission from said user, i. a memory storage device for storing software and voice signatures.

* * * * *